US005792724A

United States Patent [19]

Suzaki et al.

[11] Patent Number: 5,792,724

[45] Date of Patent: Aug. 11, 1998

[54] THERMOSENSITIVE RECORDING MATERIAL

[75] Inventors: Hideo Suzaki, Numazu; Hideo Aihara, Fuji, both of Japan

[73] Assignee: Ricoh Co., Ltd., Tokyo, Japan

[21] Appl. No.: 636,459

[22] Filed: Apr. 23, 1996

[30] Foreign Application Priority Data

Apr. 24, 1995 [JP] Japan ..... 7-120452
Mar. 28, 1996 [JP] Japan ..... 8-097372

[51] Int. Cl.[6] ..... B41M 5/40

[52] U.S. Cl. ..... 503/214; 427/152; 503/700; 503/204; 503/226

[58] Field of Search ..... 427/150–152; 503/200, 214, 216, 226

[56] References Cited

U.S. PATENT DOCUMENTS

| | | | |
|---|---|---|---|
| 4,950,638 | 8/1990 | Yuyama et al. | 503/226 |
| 4,975,408 | 12/1990 | Motosugi et al. | 503/226 |
| 5,151,403 | 9/1992 | Suzuki et al. | 503/200 |
| 5,189,007 | 2/1993 | Aihara et al. | 503/207 |
| 5,229,349 | 7/1993 | Kurisu et al. | 503/200 |
| 5,447,900 | 9/1995 | Suzaki et al. | 503/207 |
| 5,482,911 | 1/1996 | Hiroishi et al. | 503/200 |
| 5,482,912 | 1/1996 | Furuya et al. | 503/207 |

FOREIGN PATENT DOCUMENTS

| | | | |
|---|---|---|---|
| 59-100000 | 5/1984 | Japan | 503/214 |

*Primary Examiner*—Bruce H. Hess
*Attorney, Agent, or Firm*—Oblon, Spivak, McClelland, Maier & Neustadt, P.C.

[57] ABSTRACT

A thermosensitive recording material having high transmittance density, excellent reproducibility of fine dot images and half tone images under printing conditions ranging from low to high applied printing energy.

The thermosensitive recording material, including a substrate and a thermosensitive coloring layer, formed on the substrate, the thermosensitive coloring layer including a leuco dye, a coloring developer for inducing color formation in the leuco dye upon application of heat thereto and binder resins, and an optional protective layer, formed on the thermosensitive coloring layer, wherein the binder resins include at least two resins having different glass transition temperature Tg and are present in total amount of more than about 0.25 parts by weight per 1 part of total weight of the thermosensitive coloring layer.

20 Claims, 1 Drawing Sheet

THERMOSENSITIVE RECORDING MATERIAL

BACKGROUND OF THE INVENTION

1. Field of the Invention

The present invention relates to a thermosensitive recording material utilizing the color formation caused by the chemical reaction of a coloring agent, such as an electron donor, with a coloring developer, such as an electron acceptor, and more particularly to an improved thermosensitive recording material having high image density, and excellent reproducibility of fine dot images and half tone images.

2. Discussion of the Background

Presently, a variety of recording materials are known in which a colored image is formed by the chemical reaction of a colorless or pale-colored coloring agent, such as a leuco dye, and a coloring developer for inducing color formation in contact with the leuco dye upon application of heat and/or pressure and the like.

Among these recording materials, a thermosensitive recording material is well known which has a substrate, such as a sheet of paper, synthetic paper or plastic film, a thermosensitive coloring layer which is formed on the substrate and includes a coloring agent, such as a leuco dye, and a coloring developer for inducing color formation in the leuco dye upon application of heat thereto, and when necessary, a protective layer which is formed on the thermosensitive coloring layer and includes a resin. The thermosensitive recording material has the following advantages over the other recording materials:

(1) color images can be rapidly recorded by a relative simple apparatus without complicated steps, such as development and fixing;

(2) color images can be recorded without producing noise and environmental pollution;

(3) various color images, for example, red, blue, violet and black, can be easily obtained;

(4) image density and background whiteness are high; and (5) the manufacturing cost is low.

Because of these advantages, this type of thermosensitive recording material is widely used not only as a recording material for price labels in stores, but also for copying documents and print outputs for computers, facsimiles, automatic vending machines of labels and tickets, video printers and measuring instruments.

Recently, as the demand for the thermosensitive recording material is growing, the thermosensitive recording material is required to have excellent reproducibility of half tone images and fine dot images, and high image density, particularly high transmittance density, for print outputs for medical measurement instruments and TV pictures. In order to record half tone images, an improved thermosensitive recording material is needed which has excellent reproducibility of half tone images under printing conditions ranging from low to high applied printing energy to a thermal printhead. (Hereinafter the range between the lowest and the highest applied energy in which a thermosensitive recording material is capable of reproducing excellent half tone images is referred to as dynamic range.)

In attempting to improve reproducibility of half tone images, several proposals have been made. For example, JP-A 61-98582 discloses a thermosensitive recording material in which a low temperature color forming layer including a coloring developer or thermosensitizer having a low melting point is superimposed on a high temperature color forming layer including a color developer or thermosensitizer having a high melting point. JP-A 3-55294 discloses a thermosensitive recording material in which a coloring developer and a thermosensitizer having high melting point are included in the thermosensitive coloring layer. However, these thermosensitive recording materials do not acquire dynamic ranges broad enough to be used for the above-mentioned uses in which excellent reproducibility of half tone images is required.

Due to these reasons, a need exists for thermosensitive recording materials having both high image density and excellent reproducibility of fine dot images and half tone images.

SUMMARY OF THE INVENTION

Accordingly, it is an object of the present invention to provide a thermosensitive recording material, which has excellent reproducibility of fine dot images and half tone images under printing conditions ranging from low to high applied printing energy.

It is another object of the present invention to provide a thermosensitive recording material, which has high image density, particularly high transmittance density.

The above objects and others which will become apparent from the following description are achieved by a thermosensitive recording material including a substrate, a thermosensitive coloring layer which is formed on the substrate and includes a leuco dye, a coloring developer for inducing color formation upon application of heat thereto and binder resins for binding a leuco dye and a coloring developer to the substrate, and a protective layer which is formed on the thermosensitive coloring layer, wherein the binder resins are included in the thermosensitive coloring layer in a total amount of more than about 0.25 parts by weight per 1 part of total weight of the thermosensitive coloring layer (including 0.3, 0.35, 0.4, 0.45, 0.5, 0.6, 0.7, 0.8, 0.9, etc, including all values and subranges therebetween), and include two or more binder resins having different glass transition temperature Tg.

According to an alternative embodiment, the difference between the highest Tg and the lowest Tg of the binder resins is from 30° C. to 100° C.

In another embodiment, the thermosensitive coloring layer includes two or more layers in which a thermosensitive coloring layer including a binder resin with lower Tg is superimposed on a thermosensitive coloring layer including a binder resin with higher Tg which is higher by from 30° to 100° C. than the lower Tg.

In yet another embodiment, the binder resin with lower Tg is polyvinyl butyral and the binder resin with higher Tg is polyvinyl acetoacetal.

In a further embodiment, both the leuco dye and the coloring developer have average diameters of less than about 0.5 μm.

In a still further embodiment, the physical quantity $R_p$ (printing roughness, described in detail later in DESCRIPTION OF PREFERRED EMBODIMENTS) of the protective layer is less than about 1.4 μm.

In a still further embodiment, the coloring developer includes a compound of the following formula (1):

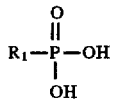

(1)

wherein $R_1$ represents linear alkyl group having from 12 to 28 carbon atoms.

In a still further embodiment, the coefficient of correlation is more than about 0.96 when the dynamic sensitivity curve which shows the relation between applied energies and the image densities is considered to be a straight line, and the maximum transmittance image density is more than about 2.0.

Therefore, according to the present invention, an improved thermosensitive recording material having high transmittance image density, and excellent reproducibility of fine dot images and half tone images is provided for the utilization in a plurality of areas of the information recording.

These and other objects, features and advantages of the present invention will become apparent upon a consideration of the following description of the preferred embodiments of the present invention taken in conjunction with the accompanying drawing.

DESCRIPTION OF THE PREFERRED EMBODIMENTS

Figure 1:
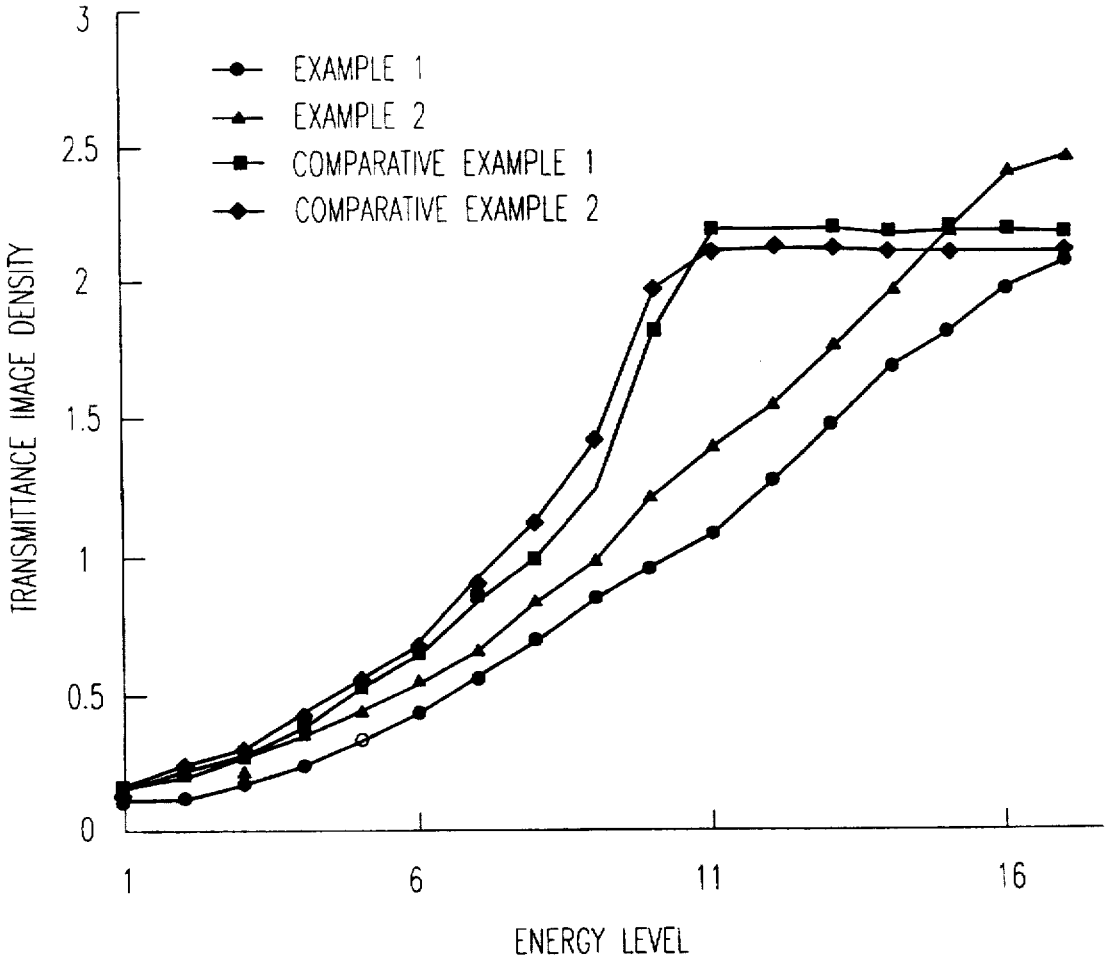
FIG. 1 shows dynamic thermosensitivity curves of examples of the thermosensitive recording materials according to the present invention in comparison with comparative examples.

The present invention is predicated upon the discovery that a thermosensitive recording material having high transmittance image density, and excellent reproducibility of fine dot images and half tone images, can be provided by a thermosensitive recording material including a substrate, a thermosensitive coloring layer which is formed on the substrate and includes a leuco dye, a coloring developer for inducing color formation upon application of heat thereto and binder resins for binding a leuco dye and a coloring developer to the substrate, and an optional protective layer formed on the thermosensitive coloring layer, wherein the binder resins are included in the thermosensitive coloring layer in a total amount of more than 0.25 parts by weight per 1 part of total weight of the thermosensitive coloring layer, and include two or more binder resins having different Tg.

As a coloring agent for use in the present invention, which is an electron donor compound and may be employed individually or in combination, any known colorless or pale-colored dye precursor conventionally used in thermosensitive recording materials can be employed. For example, such leuco compounds as triphenylmethanephthalide, triallylmethane, fluoran, phenothiazine, thiofluoran, xanthene, indophthalyl, spiropyran, azaphthalide, chromenopyrazole, methine, rhodamineanilinolactam, rhodaminelactam, quinazoline, diazaxanthene and bislactone are preferably employed.

Specific examples of useful leuco dyes are as follows but are not limited to:

2-anilino-3-methyl-6-diethylaminofluoran, 2-anilino-3-methyl-6-(di-n-butylamino)fluoran, 2-anilino-3-methyl-6-(N-n-propyl-N-methylamino) fluoran, 2-anilino-3-methyl-6-(N-isopropyl-N-methylamino) fluoran, 2-anilino-3-methyl-6-(N-isobutyl-N-methylamino) fluoran, 2-anilino-3-methyl-6-(N-n-amyl-N-methylamino) fluoran, 2-anilino-3-methyl-6-(N-sec-butyl-N-ethylamino) fluoran, 2-anilino-3-methyl-6-(N-n-amyl-N-ethylamino)fluoran, 2-anilino-3-methyl-6-(N-n-isoamyl-N-ethylamino) fluoran, 2-anilino-3-methyl-6-(N-n-propyl-N-isopropylamino) fluoran, 2-anilino-3-methyl-6-(N-cyclohexyl-N-methylamino) fluoran, 2-anilino-3-methyl-6-(N-ethyl-p-toluidino)fluoran, 2-anilino-3-methyl-6-(N-methyl-p-toluidino)fluoran, 2-(m-trichloromethylanilino)-3-methyl-6-diethylaminofluoran, 2-(m-trifluoromethylanilino)-3-methyl-6-diethylaminofluoran, 2-(m-trifluoromethylanilino)-3-methyl-6-(N-cyclohexyl-N-methylamino)fluoran, 2-(2,4-dimethylanilino)-3-methyl-6-diethylaminofluoran, 2-(N-ethyl-p-toluidino)-3-methyl-6-(N-ethylanilino) fluoran, 2-(N-methyl-p-toluidino)-3-methyl-6-(N-propyl-p-toluidino)fluoran, 2-anilino-6-(N-n-hexyl-N-ethylamino)fluoran, 2-(o-chloroanilino)-6-diethylaminofluoran, 2-(o-bromoanilino)-6-diethylaminofluoran, 2-(o-chloroanilino)-6-dibutylaminofluoran, 2-(o-fluoroanilino)-6-dibutylaminofluoran, 2-(m-trifluoromethylanilino)-6-diethylaminofluoran, 2-(p-acetylanilino)-6-(N-n-amyl-N-n-butylamino) fluoran, 2-benzylamino-6-(N-ethyl-p-toluidino)fluoran, 2-benzylamino-6-(N-methyl-2,4-dimethylanilino)fluoran, 2-benzylamino-6-(N-ethyl-2,4-dimethylanilino)fluoran, 2-benzylamino-6-(N-methyl-p-toluidino)fluoran, 2-benzylamino-6-(N-ethyl-p-toluidino)fluoran, 2-(di-p-methylbenzylamino)-6-(N-ethyl-p-toluidino) fluoran, 2-(α-phenylethylamino)-6-(N-ethyl-p-toluidino)fluoran, 2-methylamino-6-(N-methylanilino)fluoran, 2-methylamino-6-(N-ethylanilino)fluoran, 2-methylamino-6-(N-propylanilino)fluoran, 2-ethylamino-6-(N-methyl-p-toluidino)fluoran, 2-methylamino-6-(N-methyl-2,4-dimethylanilino) fluoran, 2-ethylamino-6-(N-methyl-2,4-dimethylanilino)fluoran, 2-dimethylamino-6-(N-methylanilino)fluoran, 2-dimethylamino-6-(N-ethylanilino)fluoran, 2-diethylamino-6-(N-methyl-toluidino)fluoran, 2-diethylamino-6-(N-ethyl-p-toluidino)fluoran, 2-dipropylamino-6-(N-methylanilino)fluoran, 2-dipropylamino-6-(N-ethylanilino)fluoran, 2-amino-6-(N-methylanilino)fluoran, 2-amino-6-(N-ethylanilino)fluoran, 2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran,
1,2-benzo-6-dibutylaminofluoran,
1,2-benzo-6-(N-ethyl-N-cyclohexylamino)fluoran,
1,2-benzo-6-(N-ethyl-p-toluidino)fluoran,
2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-ethyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino) fluoran,
2-(α-phenylethylamino)-4-methyl-6-diethylaminofluoran,
2-(p-toluidino)-3-(t-butyl)-6-(N-methyl-p-toluidino) fluoran,
2-(o-methoxycarbonylanilino)-6-diethylaminofluoran,
2-acetylamino-6-(N-methyl-p-toluidino)fluoran,
3-diethylamino-6-(m-trifluoromethylanilino)fluoran,
4-methoxy-6-(N-ethyl-p-toluidino)fluoran,
2-ethoxyethylamino-3-chloro-6-dibutylaminofluoran,
2-dibenzylamino-4-chloro-6-(N-ethyl-p-toluidino) fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino)fluoran,
2-mesidino-4',5',-benzo-6-diethylaminofluoran,
2-(m-trifluoromethylanilino)-3-methyl-6-pyrrolidinofluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholinofluoran,
2-(di-N-p-chlorophenyl-methylamino)-6-pyrrolidinofluoran,
2-(N-n-propyl-m-trifluoromethylanilino)-6-morpholinofluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran,
benzo leuco methyleneblue,
2-{3,6-bis(diethylamino)}-6-(o-chloroanilino) xanthylbenzoic acid lactam,
2-{3,6-bis(diethylamino)}-9-(o-chloroanilino) xanthylbenzoic acid lactam,
3,3-bis(p-dimethylaminophenyl)phthalide,
3,3-bis(p-dimethylaminophenyl)-6-dimethylaminophthalide or Crystal Violet Lactone,
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(2-methoxy-4-dimethylaminophenyl)-3-(2-hydroxy-4,5-dichlorophenyl)phthalide,
3-(2-hydroxy-4-dimethylaminophenyl)-3-(2-methoxy-5-chlorophenyl)phthalide,
3-(2-hydroxy-4-dimethoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phtalide,
3,6-bis(dimethylamino)fluorenespiro(9,3')-6'-dimethylaminophthalide,
6'-chloro-8'-methoxy-benzoindorino-spiropyran, and
6'-bromo-2'-methoxy-benzoindorino-spiropyran.

As a coloring developer for use in the present invention, which is an electron acceptor and may be employed individually or in combination, any known coloring developer conventionally used in thermosensitive recording materials can be employed. Preferable coloring developers in the present invention are the electron acceptors having a long chain alkyl group which are disclosed in, for example, JP-A 5-124360, incorporated herein by reference. For example, organic phosphoric acid compounds, aliphatic carboxylic acid compounds, phenolic compounds, each including an aliphatic group having greater than or equal to 12 carbon atoms, metal salts of mercaptoacetic acid including an aliphatic group having from 10 to 18 carbon atoms, alkyl esters of caffeic acid including an alkyl group having from 5 to 8 carbon atoms, and acidic esters of phosphoric acid including an aliphatic group having greater than or equal to 16 carbon atoms are preferably employed. The above-mentioned aliphatic group includes a linear alkyl group, a branched alkyl group, a linear alkenyl group and a branched alkenyl group, and may have substituents of, for example, a halogen, an alkoxy group and an ester. Specific examples of those coloring developers are as follows but are not limited to:

A) organic phosphoric acid compounds

A preferable organic phosphoric acid compound is represented by the following formula (1):

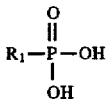

(1)

wherein $R_1$ represents a linear alkyl group having from 12 to 28 carbon atoms.

Specific examples of the compound represented by formula (1) are as follows:

dodecylphosphonate,
tetradecylphosphonate,
hexadecylphosphonate,
octadecylphosphonate,
eicosylphosphonate,
docosylphosphonate,
tetracosylphosphonate,
hexacosylphosphonate, and
octacosylphosphonate.

Another preferable organic phosphoric acid compound is α-hydroxyalkylphosphonate compound represented by the following formula (2):

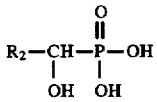

(2)

wherein $R_2$ represents an aliphatic group having from 11 to 29 carbon atoms.

Specific examples of the compound represented by the formula (2) are as follows:

α-hydroxydodecylphosphonate,
α-hydroxytetradecylphosphonate,
α-hydroxyhexadecylphosphonate,
α-hydroxyoctadecylphosphonate,
α-hydroxyeicosylphosphonate,
α-hydroxydocosylphosphonate, and
α-hydroxytetracosylphosphonate.

Yet another preferable organic phosphoric compound is an acidic organic phosphoric acid ester compound represented by the following formula (3):

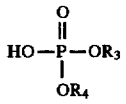

(3)

wherein R3 represents an aliphatic group having more than or equal to 16 carbon atoms, and $R_4$ represents hydrogen or an aliphatic group having more than or equal to 1 carbon atoms.

Specific examples of the compound represented by the formula (3) are as follows:

dihexadecylphosphate,
dioctadecylphosphate,
dieicosylphosphate,
didocosylphosphate,
monohexadecylphosphate,
monooctadecylphosphate,
monoeicosylphosphate,
monodocosylphosphate,
methylhexadecylphosphate,
methyloctadecylphosphate,
methyleicosylphosphate,
methyldocosylphosphate,
amylhexadecylphosphate,
octylhexadecylphosphate, and
laurylhexadecylphosphate.

(B) aliphatic carboxylic acid compounds

A preferable aliphatic carboxylic acid compound is α-hydroxy aliphatic acid compound represented by the following formula (4):

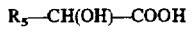

(4)

wherein $R_5$ represents an aliphatic group having more than or equal to 12 carbon atoms.

Specific examples of the compound are as follows:

α-hydroxy decanoic acid,
α-hydroxy tetradecanoic acid,
α-hydroxy hexadecanoic acid,
α-hydroxy octadecanoic acid,
α-hydroxy pentadecanoic acid,
α-hydroxy eicosanoic acid,
α-hydroxy docosanoic acid,
α-hydroxy tetracosanoic acid,
α-hydroxy hexacosanoic acid, and
α-hydroxy octacosanoic acid.

Another preferable aliphatic carboxylic acid compound is aliphatic carboxylic acid including an aliphatic group having greater than or equal to 12 carbon atoms, and a halogen in at least one of its α or β position carbon atom.

Specific examples of such a compound are as follows:

2-bromohexadecanoic acid,
2-bromoheptadecanoic acid,
2-bromooctadecanoic acid,
2-bromoeicosanoic acid,
2-bromodocosanoic acid,
2-bromotetracosanoic acid,
3-bromooctadecanoic acid,
3-bromoeicosanoic acid,
2, 3-dibromooctadecanoic acid,
2-fluorododecanoic acid,
2-fluorotetradecanoic acid,
2-fluorohexadecanoic acid,
2-fluorooctadecanoic acid,
2-fluoroeicosanoic acid,
2-fluorodocosanoic acid,
2-iodohexadecanoic acid,
2-iodooctadecanoic acid,
3-iodohexadecanoic acid,
3-iodooctadecanoic acid, and
perfluorooctadecanoic acid.

Yet another preferable aliphatic carboxylic acid compound is aliphatic carboxylic acid compound including an aliphatic group having greater than or equal to 12 carbon atoms, and an oxo group in at least one of its α, β or γ position carbon atom.

Specific examples of such compounds are as follows:

2-oxododecanoic acid,
2-oxotetradecanoic acid,
2-oxohexadecanoic acid,
2-oxooctadecanoic acid,
2-oxoeicosanoic acid,
2-oxotetracosanoic acid,
3-oxododecanoic acid,
3-oxotetradecanoic acid,
3-oxohexadecanoic acid,
3-oxooctadecanoic acid,
3-oxoeicosanoic acid,
3-oxotetracosanoic acid,
4-oxohexadecanoic acid,
4-oxooctadecanoic acid, and
4-oxodocosanoic acid.

Further examples of preferable aliphatic carboxylic acid compounds are dibasic carboxylic acid compounds represented by the following formula (5):

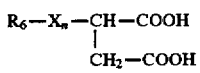

(5)

wherein $R_6$ represents an aliphatic group having greater than or equal to 12 carbon atoms, and X represents an oxygen atom or an sulfur atom and n is 1 or 2.

Specific examples of such compounds are as follows:

dodecylmalic acid,
tetradecylmalic acid,
hexadecylmalic acid,
octadecylmalic acid,
eicosylmalic acid,
docosylmalic acid,
tetracosylmalic acid,
dodecylthiomalic acid,
tetradecylthiomalic acid,
hexadecylthiomalic acid,
octadecylthiomalic acid,
eicosylthiomalic acid,
docosylthiomalic acid,
tetracosylthiomalic acid,
dodecyldithiomalic acid,
tetradecyldithiomalic acid,
eicosyldithiomalic acid,
docosyldithiomalic acid, and
tetracosyldithiomalic acid.

Still further examples of preferable aliphatic carboxylic acid compounds are dibasic carboxylic acid compounds represented by the following formula (6):

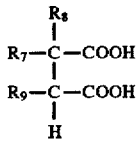

(6)

wherein $R_7$, $R_8$, and Rg independently represent a hydrogen atom or an aliphatic group, and wherein at least one of $R_7$, $R_8$ and $R_9$ is an aliphatic group having greater than or equal to 12 carbon atoms.

Specific examples of such a compound are as follows:

dodecylbutanedioic acid,
tridecylbutanedioic acid,
tetradecylbutanedioic acid,
pentadecylbutanedioic acid,
octadecylbutanedioic acid,
eicosylbutanedioic acid,
docosylbutanedioic acid,
2,3-dihexadecylbutanedioic acid,
2,3-dioctadecylbutanedioic acid,
2-methyl-3-dodecylbutanedioic acid,
2-methyl-3-tetradecylbutanedioic acid,
2-methyl-3-hexadecylbutanedioic acid,
2-ethyl-3-dodecylbutanedioic acid,
2-propyl-3-dodecylbutanedioic acid,
2-octyl-3-hexadecylbutanedioic acid, and
2-tetradecyl-3-octadecylbutanedioic acid.

Still further examples of preferable aliphatic carboxylic acid compounds are dibasic carboxylic acids represented by the following formula (7):

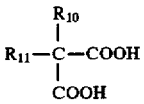

(7)

wherein $R_{10}$ and $R_{11}$ independently represent a hydrogen atom or an aliphatic group, and at least one of $R_{10}$ and $R_{11}$ is an aliphatic group having greater than or equal to 12 carbon atoms.

Specific examples of such a compound are as follows:

dodecylmalonic acid,
tetradecylmalonic acid,
hexadecylmalonic acid,
octadecylmalonic acid,
eicosylmalonic acid,
docosylmalonic acid,
tetracosylmalonic acid,
didodecylmalonic acid,
ditetradecylmalonic acid,
dihexadecylmalonic acid,
dioctadecylmalonic acid,
dieicosylmalonic acid,
didocosylmalonic acid,
methyloctadecylmalonic acid,
methyldocosylmalonic acid,
methyltetracosylmalonic acid,
ethyloctadecylmalonic acid,
ethyleicosylmalonic acid,
ethyldocosylmalonic acid, and
ethyltetracosylmalonic acid.

Still further examples of preferable aliphatic carboxylic acid compounds are dibasic carboxylic acids represented by the following formula (8):

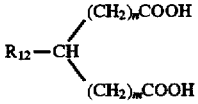

(8)

wherein $R_{12}$ represents a hydrogen atom or an aliphatic group with n being 0 or 1 and m being 1, 2 or 3, provided when n is 0, m is 2 or 3, and provided when n is 1, m is 1 or 2.

Specific examples of such compounds are as follows:

2-dodecyl-pentanedioic acid, 2-hexadecyl-pentanedioic acid, 2-octadecyl-pentanedioic acid, 2-eicosyl-pentanedioic acid, 2-docosyl-pentanedioic acid, 2-dodecyl-hexanedioic acid, 2-pentadecyl-hexanedioic acid, 2-octadecyl-hexanedioic acid, 2-eicosyl-hexanedioic acid, and 2-docosyl-hexanedioic acid.

A still further example of preferable aliphatic carboxylic acid compounds is tribasic acid compound which is acylated by a long chain aliphatic acid.

Specific examples of such a compound are as follows:

o-palmitylcitric acid

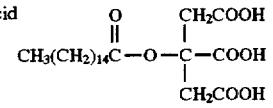

o-stearylcitric acid

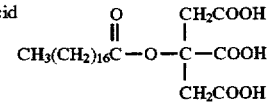

o-eicosylcitric acid

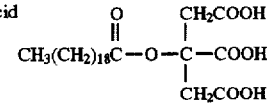

(C) Phenolic Compounds

A preferable phenolic compound is a phenolic compound represented by the following formula (9):

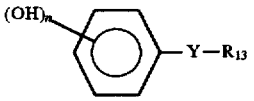

(9)

wherein Y represents —S—, —O—, —CONH— or —COO—, and $R_{13}$ represents an aliphatic group having greater than or equal to 12 carbon atoms and n is 1, 2 or 3.

Specific examples of such a compound are as follows:

p-(dodecylthio)phenol, p-(tetradecylthio)phenol, p-(hexadecylthio)phenol, p-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecylcarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, hexadecyl gallate, octadecyl gallate, eicosyl gallate, docosyl gallate, and tetracosyl gallate.

Another preferable phenolic compound is caffeic acid alkyl esters represented by the following formula (10):

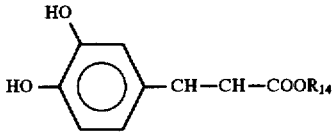

(10)

wherein $R_{14}$ represents an alkyl group having from 5 to 8 carbon atoms.

Specific examples of the compound are as follows:

caffeic acid n-pentyl ester, caffeic acid n-hexyl ester, and caffeic acid n-octyl ester.

(D) metal salt of mercaptoacetic acid

A preferable metal salt of mercaptoacetic acid is metal salt of alkyl- or alkenyl-mercaptoacetic acid represented by the following formula (11).

$$(R_{15}—S—CH_2—COO)_2M \quad (11)$$

wherein $R_{15}$ represents an aliphatic group having from 10 to 18 carbon atoms, and M represents Sn, Mg, Zn or Cu.

Specific examples of such a compound are as follows:

Sn salt of decylmercaptoacetic acid,

Sn salt of dodecylmercaptoacetic acid,

Sn salt of tetradecylmercptoacetic acid,

Sn salt of hexadecylmercaptoacetic acid,

Sn salt of octadecylmercaptoacetic acid,

Mg salt of decylmercaptoacetic acid,

Mg salt of dodecylmercaptoacetic acid,

Mg salt of tetradecylmercptoacetic acid,

Mg salt of hexadecylmercaptoacetic acid,

Mg salt of octadecylmercaptoacetic acid,

Zn salt of decylmercaptoacetic acid,

Zn salt of dodecylmercaptoacetic acid,

Zn salt of tetradecylmercptoacetic acid,

Zn salt of hexadecylmercaptoacetic acid,

Zn salt of octadecylmercaptoacetic acid,

Cu salt of decylmercaptoacetic acid,

Cu salt of dodecylmercaptoacetic acid,

Cu salt of tetradecylmercptoacetic acid,

Cu salt of hexadecylmercaptoacetic acid, and

Cu salt of tadecylmercaptoacetic acid.

The preferable content of the coloring developer is from about 1 to 20 parts by weight, more preferably from about 2 to 10 parts by weight including 3, 4, 5, 6, 7, 8, and 9 and all values and subranges therebetween, per 1 part by weight of the coloring agent in the thermosensitive coloring layer.

The thermosensitive recording material can be formed by coating on a substrate a thermosensitive coloring layer coating liquid including a coloring agent, a coloring developer and binder resins, and drying the coated liquid, and, when necessary, coating on the thermosensitive coloring layer a protective layer coating liquid including a resin and drying the coated liquid. The preferable content of the binder resins is more than about 0.25 parts by weight per 1 part by total weight of the thermosensitive coloring layer.

The thermosensitive recording material of the present invention which has excellent reproducibility of half tone images under printing conditions ranging from low to high applied printing energy can be obtained by forming a thermosensitive coloring layer including two or more binder resins which have different Tg. The difference between the highest Tg and the lowest Tg of the binder resins is preferably from 30° C. to 100° C. The mixing ratio of the binder resins in the thermosensitive coloring layer is preferably varied with the amount of the applied printing energy and the thickness of the protective layer, but the content of a main binder resin is preferably more than about 0.05 parts by weight, more preferably, more than about 0.10 parts by weight per 1 part by total solid weight of binder resins in order to control the thermosensitivity.

The reason for the improvement of the reproducibility of half tone images in the present invention is considered to be as follows. When the content of the binder resins in the thermosensitive coloring layer is more than about 0.25 parts by weight per 1 part by total solid weight of the thermosensitive coloring layer, the coloring agent and coloring developer become isolated from each other by the binder resins, so that chemical reaction to form a color image with the coloring agent and the coloring developer can be controlled mostly by Tg of the binder resins. Accordingly, the thermosensitivity of the thermosensitive recording material of the present invention can be controlled by the mixing ratio of a binder resin with higher Tg and a binder resin with lower Tg, so that the excellent reproducibility of half tone images over a wide range of applied printing energy can be obtained.

The invention thermosensitive coloring layer, as that term is used herein, may be formed by one layer, or two or more layers. The thermosensitive recording material having high transmittance image density and excellent reproducibility of fine dot images and half tone images is preferably made by forming two or more thermosensitive coloring layers which include a binder resin with lower Tg in the upper layer and a binder resin with higher Tg in the lower layer. The thermosensitive recording material used for print outputs for medical measurement instruments and TV pictures is required to have maximum transmittance image density of more than about 2.0 and excellent linear dynamic thermosensitivity curve of which linearity is more than about 0.96 in the coefficient of correlation. The dynamic thermosensitivity curve as used in the present invention is defined as the curve showing the relation between the transmittance image densities and the applied printing energies divided into 17 equal levels ranging from about 4 to 16 $mJ/mm^2$. The coefficient of correlation is calculated from the above-mentioned dynamic thermosensitivity curve by the method of least squares, and the closer to 1.0 the coefficient of correlation becomes, i.e. the closer to maximum value the coefficient of correlation becomes, the better reproducibility of half tone images can be obtained.

As the binder resins for use in the thermosensitive coloring layer of the present invention, any conventional resin can be employed, and two or more binder resins having different Tg are included in a thermosensitive coloring layer and/or included individually in different thermosensitive coloring layers in such a way that the binder resin with lower Tg is included in the upper layer. The preferred Tg ranges from 30° to 250° C., more preferably 50° to 200° C.

Specific examples of the binder resins are as follows:

polyacrylamide,
maleic acid copolymer,
polyacrylate,
polymethacrylate,
copolymer of vinyl chloride and vinyl acetate,
styrene copolymer,
polyester,
polyurethane,
polyvinyl butyral,
ethylcellulose,
polyvinyl acetal,
polyvinyl acetoacetal,
polycarbonate,
epoxy resin, and
polyamide.

Such resins are known in the art, as are methods of their manufacture. The dynamic thermosensitivity may also be controlled by changing the molecular weight of a binder resin, or mixing more than two binder resins, or mixing binder resins and an additive such as a plasticizer, for example, to change the flexibility of the resin. With regard to mixtures of binder resins, a preferred embodiment includes a mixture of two or more different binder resins each with a unique Tg. For example, a mixture of polyvinyl butyral resin and polyvinyl acetoacetal resin where the Tg of the former is lower than that of the latter is preferred. Another example of such a binder mixture is resin 1 (small content)/resin 2 (large content, main binder)/resin 3 (large content)/resin 4 (small content) where Tg1 (i.e., the Tg of resin 1) is the lowest of the four with Tg increasing in the order Tg1, Tg2, Tg3, Tg4. Resin 2 is preferably polyvinyl butral and Resin 3 is preferably polyvinyl acetoacetal.

The formation of the thermosensitive coloring layer of the present invention can be achieved by the steps of, for example, preparing a coating liquid, coating the liquid on a substrate by means of a conventional coating method, and drying the coated liquid. The coating liquid can be prepared by mixing and dispersing uniformly or dissolving a coloring agent, a coloring developer and binder resins in water and/or an organic solvent. The average particle diameter of coloring agent and coloring developer in the thermosensitive coating liquid is preferably less than about 0.5 μm in order to improve the reproducibility of fine dot images by making the surface of the thermosensitive recording material smooth.

The dry thickness of the thermosensitive coloring layer, which depends on the formulation of the coating liquid and the application of the thermosensitive recording material, is preferably from about 1 to 50 μm, more preferably from about 3 to 20 μm.

The thermosensitive coloring layer may further include auxiliary agents which are employed in conventional thermosensitive recording materials to improve coating property, printing property and preservability of the thermosensitive recording materials. These auxiliary agents are, for example, filler, surface active agent, lubricant and an agent to prevent coloring by pressure application.

Specific examples of the filler for use in the thermosensitive coloring layer of the present invention include inorganic pigments such as calcium carbonate, silica, zinc oxide, titanium dioxide, aluminum hydroxide, zinc hydroxide, barium sulfate, clay, caoline, talc, surface treated calcium carbonate or silica, and organic pigments such as urea-formaldehyde resin, styrene-methacrylic acid copolymer, polystyrene and polyvinylidene chloride resin.

Specific examples of the lubricant for use in the present invention include a higher fatty acid and its derivatives, an amide of higher fatty acid, an ester of higher fatty acid, a animal wax, a vegetable wax, a mineral wax and a petroleum wax.

The substrates for use in the present invention are preferably as follows but are not limited to:

polyester film such as polyethyleneterephthalate and polybutyleneterephthalate, cellulose film such as triacetate cellulose, olyolefin film such as polyethylene and polypropylene, polystyrene film, paper, and synthetic paper.

These films are used individually or in a combination in which a plurality of films are laminated each other.

The thermosensitive recording material may further include a intermediate layer containing a filler, a binder and a thermofusible material between the substrate and the thermosensitive coloring layer to make the surface of the thermosensitive recording material smooth.

The thermosensitive recording material may further include a protective layer which is formed on the thermosensitive coloring layer in order to improve the resistance to light, chemicals, water and rubbing, and to prevent sticking to a thermal printhead. The physical quantity $R_p$ (printing roughness) which is inversely proportional to the surface smoothness of the protective layer is preferably less than about 1.4 μm in order to improve the reproducibility of fine dot images. The quantity $R_p$ is described in detail in A METHOD TO MEASURE SURFACE SMOOTHNESS OF PAPER BY OPTICAL CONTACT METHOD by S. Sakuramoto, Laboratory Report of the Printing Bureau of the Finance Ministry of Japan, Vol.29, no. 9, pp 615–622 (1977), incorporated herein by reference, and measured by MICROTOPOGRAPH manufactured by Toyo Seiki Co., Tokyo, Japan, using a prism as a measuring medium under a pressure of 13.5 $Kgf/cm^2$.

A variety of resins can be employed for the protective layer of the present invention. For example, a water-soluble resin, a water-insoluble resin including an aqueous emulsion, a ultraviolet crosslinking resin and electron beam crosslinking resin are preferably employed. These resins can be employed individually or in combination.

Specific examples of the water-soluble resin are as follows:

polyvinyl alcohol, modified polyvinyl alcohol, cellulose derivatives such as methylcellulose, methoxycellulose and hydroxycellulose, casein, gelatin, polyvinyl pyrrolidone, styrene-maleic anhydride copolymer, diisobutylene-maleic anhydride copolymer, methylvinylether-maleic anhydride copolymer, polyacryl amide, modified polyacryl amide, polyvinyl alcohol-acryl amide copolymer, carboxy-modified polyethylene, melamine-formaldehyde resin and urea-formaldehyde resin.

Specific examples of the water-insoluble resin and aqueous emulsion are as follows:

polyvinylacetate, polyurethane, styrene-butadiene copolymer, styrene-butadiene-acrylate copolymer, polyacrylic acid, polyacrylate, polybutyl methacrylate, vinyl chloride-vinyl acetate copolymer, and ethylene-vinyl acetate copolymer, When necessary, the resins which are modified versions of the above-mentioned resins with a silicon-including group and/or are capable to crosslink by a crosslinking agent can also be employed.

As the ultraviolet crosslinking resin for use in the present invention, any conventional ultraviolet crosslinking resin can be employed. For example, a monomer, an oligomer or a prepolymer which is capable to polymerize and crosslink by ultraviolet rays can be employed.

As the electron beam crosslinking resin for use in the present invention, any conventional electron beam crosslinking resin can be employed. A branched polyester resin having five or more functional groups and a silicone-modified resin which is capable to crosslink by electron beams are preferably employed.

The protective layer may further include a filler and/or a lubricant in an amount which keeps the quantity $R_p$ of the surface of the protective layer less than about 1.4 μm.

As the filler for use in the protective layer of the present invention, which may be employed individually or in combination, any known inorganic and organic pigment can be employed. A pigment of which oil absorption is more than about 30 ml/100 g, more preferably more than about 80 ml/100 g, is preferably employed for the protective layer of the present invention.

Specific examples of the filler are as follows:

(inorganic pigments)

calcium carbonate, silica, zinc oxide, titanium dioxide, aluminum hydroxide, zinc hydroxide, barium sulfate, clay, talc, surface treated calcium carbonate, and surface treated silica.

(organic pigments)

urea-formaldehyde resin, styrene-methacrylic acid copolymer, and polystyrene.

The formation of the protective layer of the present invention can be achieved by the steps of, for example, preparing a coating liquid, coating the liquid on the thermosensitive coloring layer by means of a conventional coating method, and drying the coated liquid. The surface of the protective layer is prepferably smooth such that the quantity $R_p$ is less than about 1.4 μm.

The dry thickness of the protective layer is preferably from about 0.1 to 20 μm, more preferably from about 0.5 to 10 μm. When the thickness of the protective layer is in the range of above-mentioned thickness, there are advantages which follow:

(a) The resistance of image to light, chemicals, water, rubbing, and sticking to thermal printhead remains excellent;

(b) The dynamic thermosensitivity of the thermosensitive recording material remains fast; and (c) The manufacturing cost is not expensive.

As a printing method to print images on the thermosensitive recording material of the present invention, any conventional printing method using, for example, thermal pen, a thermal printhead and laser beams may be used.

The thermosensitive recording material of the present invention has good transparency, and accordingly it is useful for transparent thermosensitive recording as well as normal thermosensitive recording.

Other features of this invention will become apparent from the following description of exemplary embodiments, which are provided solely for purpose of illustration and are not intended to be limitative. In the descriptions in the following examples, numerals are in weight ratio unless otherwise specified.

EXAMPLES

Example 1

(Formation of thermosensitive coloring layer)

A mixture of the following compounds was pulverized and dispersed in a ball mill in order that the average particle diameter of the liquid came to be 0.3 μm, so that a Liquid A is prepared:

| (Liquid A) | parts by weight |
|---|---|
| 3-diethylamino-6-methyl-7-anilinofluoran | 4 |
| octadecyl phosphonate | 12 |
| polyvinyl butyral (Denka Butyral #3000-2, Tg = 60° C., manufactured by Denki Kagaku Kogyo Co.) | 4 |
| polyvinyl acetoacetal (KS-1, Tg = 100° C., manufactured by Sekisui Chemical Co.) | 12 |
| toluene | 57 |
| methyl ethyl ketone | 57 |

The liquid A was coated on a substrate of PET film of 75 μm thick, and dried to form a thermosensitive coloring layer of 10 μm in dry thickness.

(Formation of protective layer)

The following components were mixed to prepare a coating liquid B for a protective layer:

| (Liquid B) | parts by weight |
|---|---|
| 15% silicone-modified butyral resin toluene solution (SP-712, manufactured by Dainichiseika Color & Chemical Mfg. Co.) | 75 |
| methyl ethyl ketone | 85 |

The liquid B was coated on the previously prepared thermosensitive coloring layer, and dried to form a protective layer of 3 μm in dry thickness. The quantity $R_p$ of the surface of the protective layer is 0.6 μm. Thus, a thermosensitive recording material of the present invention was obtained.

Example 2

(Formation of thermosensitive coloring layer)

A mixture of the following compounds was individually pulverized and dispersed in a ball mill in order that the average particle diameter of each liquid became to be 0.3 μm, so that a liquid C and liquid D were prepared.

| | parts by weight |
|---|---|
| (Liquid C) | |
| 3-diethylamino-6-methyl-7-anilinofluoran | 4 |
| octadecyl phosphonate | 12 |
| polyvinyl butyral (Denka Butyral #3000-2) | 6 |
| polyvinyl acetoacetal (KS-1) | 1 |
| toluene | 57 |
| methyl ethyl ketone | 57 |
| (Liquid D) | |
| 3-diethylamino-6-methyl-7-anilinofluoran | 4 |
| octadecyl phosphonate | 12 |
| polyvinyl butyral (Denka Butyral #3000-2) | 6 |
| polyvinyl acetoacetal (KS-1) | 18 |
| toluene | 57 |
| methyl ethyl ketone | 57 |

The liquid D was coated on a substrate of PET film of 75 μm thick, and dried to form a primary thermosensitive coloring layer. Then the liquid C was coated on the primary thermosensitive coloring layer, and dried to form a secondary thermosensitive coloring layer. The total dry thickness of the thermosensitive coloring layer is 12 μm.

(Formation of protective layer)

The following components were mixed to prepare a coating liquid F for a protective layer.

| (Liquid F) | parts by weight |
|---|---|
| 7% silicone-modified butyral resin toluene solution (SP-712) | 77 |
| methyl ethyl ketone | 20 |
| silica (average particle diameter is 0.2 μm) | 3 |

The liquid F was coated on the previously prepared thermosensitive coloring layer and dried to form a protective layer with a dry thickness of 3 μm. The quantity $R_p$ of the surface of the protective layer is 1.3 μm.

Example 3

(Formation of thermosensitive layer)

A mixture of the following compounds was pulverized and dispersed in a ball mill in order that the average particle diameter of the liquid became to be 0.3 μm, so that a liquid G was prepared:

| (Liquid G) | parts by weight |
|---|---|
| 3-diethylamino-6-methyl-7-anilinofluoran | 4 |
| octadecyl phosphonate | 12 |
| polyvinyl butyral (Denka Butyral #3000-2) | 4 |
| polyvinyl acetoacetal (BX-1, Tg = 85° C., manufactured by Sekisui Chemical Co.) | 12 |
| toluene | 57 |
| methyl ethyl ketone | 57 |

The liquid G was coated on a substrate of PET film of 75 μm thick, and dried to form a thermosensitive coloring layer of 10 μm in dry thickness.

(Formation of protective layer)

The liquid B was coated on the previously prepared thermosensitive coloring layer, and dried to form a protective layer of 3 μm in dry thickness. The quantity $R_p$ of the surface of the protective recording material was 0.6 μm.

Example 4

(Formation of thermosensitive coloring layer)

A mixture of the following compounds was pulverized and dispersed in a ball mill in order that the average particle diameter of the liquid became to be 1.0 μm, so that a liquid H was prepared:

| (Liquid H) | parts by weight |
|---|---|
| 3-diethylamino-6-methyl-7-anilinofluoran | 4 |
| octadecyl phosphonate | 12 |
| polyvinyl butyral (Denka Butyral #3000-2) | 4 |
| polyvinyl acetoacetal (KS-1) | 12 |
| toluene | 57 |
| methyl ethyl ketone | 57 |

The liquid H was coated on a substrate of PET film of 75 μm thick, and dried to form a thermosensitive coloring layer of 10 μm in dry thickness.

(Formation of protective layer)

The following components were mixed to prepare a coating liquid I for a protective layer:

| (Liquid I) | parts by weight |
|---|---|
| 7% silicone-modified butyral resin toluene solution (SP-712) | 77 |
| methyl ethyl ketone | 20 |
| silica (average particle diameter is 0.5 μm) | 3 |

The liquid I was coated on the previously prepared thermosensitive coloring layer, and dried to form a protective layer of 3 μm in dry thickness. The quantity $R_p$ of the surface of the protective layer is 1.7 μm.

Comparative Example 1

(Formation of thermosensitive coloring layer)

A mixture of the following components was pulverized and dispersed in a ball mill in order that the average particle diameter of the liquid became to be 0.3 μm, so that a liquid J was prepared:

| (Liquid J) | parts by weight |
|---|---|
| 3-diethylamino-6-methyl-7-anilinofluoran | 4 |
| octadecyl phosphonate | 12 |
| polyvinyl butyral (Denka Butyral #3000-2) | 6 |
| toluene | 57 |
| methyl ethyl ketone | 57 |

The liquid J was coated on a substrate of PET film of 75 μm thick, and dried to form a thermosensitive coloring layer of 8 μm in dry thickness.

(Formation of protective layer)

The liquid B was coated on the previously prepared thermosensitive coloring layer to form a protective layer of 3 μm in dry thickness. The quantity $R_p$ of the surface of the protective layer was 0.6 μm. Thus, a comparative thermosensitive recording material was obtained.

Comparative Example 2

(Formation of thermosensitive coloring layer)

A mixture of the compounds was pulverized and dispersed in a ball mill in order that the average particle diameter became to be 0.3 μm, so that a liquid K was prepared:

| (Liquid K) | parts by weight |
|---|---|
| 3-diethylamino-6-methyl-7-anilinofluoran | 4 |
| octadecyl phosphonate | 12 |
| polyvinyl butyral (Denka Butyral #3000-2) | 2 |
| polyvinyl acetoacetal (KS-1) | 1 |
| toluene | 57 |
| methyl ethyl ketone | 57 |

The liquid K was coated on a substrate of PET film of 75 μm thick, and dried to form a thermosensitive coloring layer of 7 μm in dry thickness.

(Formation of protective layer)

The liquid B was coated on the previously prepared thermosensitive coloring layer, and dried to form a protective layer of 3 μm in dry thickness. The quantity $R_p$ of the surface of the protective layer was 0.6 μm.

In accordance with the following methods, each of the thermosensitive recording materials of the present invention obtained in Examples 1 through 4 and the comparative thermosensitive recording materials in Comparative Example 1 through 2 were evaluated with respect to dynamic thermosensitivity, transmittance image density, reproducibility of fine dot images and fidelity of printed image.

The relation between energy levels and print energies shown in Table 1 and results are shown in FIG. 1 and Table 2.

(1) Dynamic thermosensitivity and transmittance density

A solid-developed image was printed by a thermal printing simulator, manufactured by Ookura Electric Co., on each thermosensitive recording material. The applied energy to the thermal print head which is described in Table 1 was changed by 17 energy levels from 3.9 mJ/mm$^2$ to 16.3 mJ/mm$^2$.

TABLE 1

| Energy level | 1 | 2 | 3 | 4 | 5 | 6 | 7 | 8 | 9 |
|---|---|---|---|---|---|---|---|---|---|
| Print energy (mJ/mm$^2$) | 3.9 | 4.7 | 5.5 | 6.2 | 7.0 | 7.7 | 8.5 | 9.3 | 10.1 |
| Energy level | 10 | 11 | 12 | 13 | 14 | 15 | 16 | 17 | |
| Print energy (mJ/mm$^2$) | 10.9 | 11.6 | 12.4 | 13.2 | 14.0 | 14.8 | 15.5 | 16.3 | |

The transmittance density of the printed image was measured with a transmittance densitometer 310TR manufactured by X-Rite Inc.

The coefficient of correlation was calculated by the method of least squares from the dynamic thermosensitivity curve which was obtained by exhibiting graphically regarding to the applied energy to the thermal print head and the transmittance density of the image.

(2) reproducibility of fine dot images

One dot image was continuously printed by one dot apart by the above-mentioned simulator. The applied energy to the thermal print head is 8.7 mJ/mm$^2$. The one dot image was observed through a microscope and then evaluated as follows:

○: Printed one dot image was uniform shaped.

Δ: Printed one dot image was almost uniform shaped.

X: Printed one dot image was not uniform shaped.

(3) Fidelity of printed image

A TV picture including fine dots and half tone images was reproduced by a commercially available video printer. The printed image was evaluated as follows in respect to the contrast of image, and the reproducibility of fine dot images and half tone images.

◎: Printed image was the excellent reproduction of the TV picture.

○: Printed image was the good reproduction of the TV picture.

Δ: Printed image was the acceptable reproduction of the TV picture.

X: Printed image was the poor reproduction of the TV picture.

TABLE 2

| | coefficient of correlation | maximum transmittance density | reproducibility of fine dot images | fidelity of print image |
|---|---|---|---|---|
| Example 1 | 0.98 | 2.11 | ○ | ◎ |
| Example 2 | 0.98 | 2.51 | ○ | ◎ |
| Example 3 | 0.95 | 2.20 | ○ | ○ |
| Example 4 | 0.98 | 2.05 | Δ | Δ |
| Comparative Example 1 | 0.91 | 1.90 | ○ | X |
| Comparative Example 2 | 0.91 | 1.80 | ○ | X |

As may be observed from the Tables 1 and 2 and FIG. 1, the thermosensitive recording material of the present invention which includes binder resins, each having different Tg, in total amount of more than about 0.25 parts by weight per 1 part of total weight of the thermosensitive coloring layer has high transmittance image density, excellent reproducibility of fine dot images and half tone images.

Obviously, numerous modifications and variations of the present invention are possible in light of the above teachings. It is therefore to be understood that within the scope of the appended claims, the invention may be practiced otherwise than as specifically described herein.

This application is based on Japanese patent application 07-120452 filed Apr. 24, 1995, incorporated herein by reference.

What is claimed as new and desired to be secured by Letters Patent of the United States is:

1. A thermosensitive recording material, comprising a substrate, thermosensitive coloring layer or layers formed on said substrate, and an optional protective layer formed on said thermosensitive coloring layer or layers, said thermosensitive coloring layer or layers comprising a leuco dye, a color developer for inducing color formation in said leuco dye upon application of heat, and binder resins wherein said binder resins comprise at least two binder resins having different glass transition temperatures Tg present in a total amount of more than 0.25 parts by weight per one part of total weight of said thermosensitive coloring layer or layers.

2. The thermosensitive recording material of claim 1, wherein the difference between the highest Tg and the lowest Tg of said binder resins is from 30° to 100° C.

3. The thermosensitive recording material of claim 2, wherein said thermosensitive coloring layer or layers comprise at least two layers, each comprising at least one binder resin, and the upper layer comprises a binder resin with lower Tg than the Tg of the binder resin in the lower layer.

4. The thermosensitive recording material of claim 2, wherein the binder resins comprise polyvinyl butyral and polyvinyl acetoacetal, the Tg of the polyvinyl butyral being lower than the Tg of the polyvinyl acetoacetal.

5. The thermosensitive recording material of claim 2, wherein the average particle diameter of said leuco dye and said color developer in said thermosensitive coloring layer or layers is less than 0.5 μm.

6. The thermosensitive recording material of claim 2, wherein said material comprises a protective layer, and wherein the printing roughness Rp of the surface of said protective layer is less than about 1.4 μm.

7. The thermosensitive recording material of claim 2, said color developer comprises a compound having the formula (1):

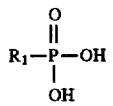

(1)

wherein $R_1$ represents a linear alkyl group having from 12 to 28 carbon atoms.

8. The thermosensitive recording material of claim 2, wherein said thermosensitive recording material has a dynamic thermosensitivity curve wherein linearity is more than about 0.96 in the coefficient of correlation and the maximum transmittance image density is more than about 2.0.

9. The thermosensitive recording material of claim 1, wherein said thermosensitive coloring layer or layers comprise at least two layers, each comprising at least one binder resin, and the upper layer comprises a binder resin with lower Tg than the Tg of the binder resin in the lower layer.

10. The thermosensitive recording material of claim 1, wherein the binder resins comprise polyvinyl butyral and polyvinyl acetoacetal, the Tg of the polyvinyl butyral being lower than the Tg of the polyvinyl acetoacetal.

11. The thermosensitive recording material of claim 1, wherein the average particle diameter of said leuco dye and said color developer in said thermosensitive coloring layer or layers is less than 0.5 μm.

12. The thermosensitive recording material of claim 1, wherein said material comprises a protective layer, and wherein the printing roughness Rp of the surface of said protective layer is less than about 1.4 μm.

13. The thermosensitive recording material of claim 1, wherein said color developer comprises a compound having the formula (1):

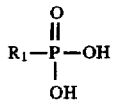

(1)

wherein $R_1$ represents a linear alkyl group having from 12 to 28 carbon atoms.

14. The thermosensitive recording material of claim 1, wherein said thermosensitive recording material has a dynamic thermosensitivity curve wherein linearity is more than 0.96 in the coefficient of correlation and the maximum transmittance image density is more than 2.0.

15. The thermosensitive recording material of claim 1, wherein the weight ratio of said color developer to said leuco dye is from about 2 to 10.

16. The thermosensitive recording material of claim 1, wherein one of said binder resins is present in said thermosensitive coloring layer or layers in more than 0.10 parts by weight per 1 part by total weight of said binder resins.

17. The thermosensitive recording material of claim 1, comprising a silicone-modified resin protective layer.

18. The thermosensitive recording material of claim 1, wherein said material comprises a protective layer comprising a resin and a crosslinking agent which react with said resin to form a crosslinked protective layer.

19. The thermosensitive recording material of claim 1, wherein said material comprises a protective layer comprising a branched polyester resin having five or more functional groups.

20. The thermosensitive recording material of claim 1, wherein said material comprises a protective layer comprising a filler with oil absorption more than about 80 ml/100 g.

* * * * *